US011325234B2

(12) United States Patent
Hu

(10) Patent No.: US 11,325,234 B2
(45) Date of Patent: May 10, 2022

(54) HAMMER TACKER

(71) Applicant: APEX MFG. CO., LTD., Taichung (TW)

(72) Inventor: Chih-Wei Hu, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 222 days.

(21) Appl. No.: 16/717,650

(22) Filed: Dec. 17, 2019

(65) Prior Publication Data

US 2021/0178565 A1 Jun. 17, 2021

(51) Int. Cl.
*B25C 5/11* (2006.01)
*B25C 5/16* (2006.01)

(52) U.S. Cl.
CPC ..... *B25C 5/11* (2013.01); *B25C 5/1617* (2013.01)

(58) Field of Classification Search
CPC ..... B25C 5/11; B25C 5/161; B25C 5/1617; B25C 5/06
See application file for complete search history.

(56) References Cited

U.S. PATENT DOCUMENTS 1,945,377 A * 1/1934 Posnack ..... B25C 5/0257 227/123
1,970,101 A * 8/1934 Maynard ..... B25C 5/1613 227/118
2,080,130 A * 5/1937 Hansen ..... B25C 5/06 173/31
2,429,269 A * 10/1947 Lindstrom ..... B25C 5/161 227/125
3,633,811 A * 1/1972 Ploen ..... B25C 5/1651 227/109
5,507,425 A * 4/1996 Ziglioli ..... B25C 5/1689 116/278
5,931,364 A * 8/1999 Dennis ..... B25C 5/1658 227/109
10,639,778 B2 * 5/2020 Wang ..... B25C 5/1617
2006/0016847 A1 * 1/2006 Kirby ..... B25C 5/025 227/134
2011/0248066 A1 * 10/2011 Hu ..... B25C 5/16 227/127

(Continued)

FOREIGN PATENT DOCUMENTS

TW M432507 U 7/2012
TW M545676 U 7/2017

*Primary Examiner* — Joshua G Kotis
(74) *Attorney, Agent, or Firm* — Muncy, Geissler, Olds & Lowe, PC

(57) ABSTRACT

A hammer tacker is provided, including a grip portion and a body portion; a magazine, including a rail, at least partially received in the housing, being movable relative to the housing between a stapling position and a staple-installing position, including an outlet disposed at a front end of the body portion; a biasing mechanism, including a push member movably mounted to the rail and a constant force spring which is rollable, the constant force spring being positionally attached to the rail through a connection portion and located at a front end of the magazine, and the constant force spring being attached to an inner face of the push member, the push member being movable to be correspondingly above or beyond the connection portion; a striking mechanism, mounted to the body portion and configured to strike at least one staple installed in the magazine.

6 Claims, 6 Drawing Sheets

(56) References Cited

U.S. PATENT DOCUMENTS

| | | | | |
|---|---|---|---|---|
| 2014/0231486 | A1* | 8/2014 | Burch | B25C 5/0285<br>227/63 |
| 2017/0057071 | A1* | 3/2017 | Pelletier | B25C 5/06 |
| 2020/0086468 | A1* | 3/2020 | Ventura | B25C 5/025 |

* cited by examiner

HAMMER TACKER

BACKGROUND OF THE INVENTION

Field of the Invention

The present invention relates to a hammer tacker.

Description of the Prior Art

A conventional hammer tacker, such as those disclosed in TW M545676 and TW M432507, includes a housing and a magazine pivoted with each other, wherein the housing includes striker disposed therein. When the hammer tacker is hammered toward the surface of an object to be nailed, the housing swings relatively toward the magazine and the staple is struck out from the magazine by the striker. The staple has to be pushed to move to be correspondingly under the striker for next striking to another staple.

In the conventional hammer tacker, a push member is connected with a tensile or compression spring so that the push member can keep pushing the staple. However, the returning force of the tensile or compression spring is in proportion to the deformation volume, such that it is harder to move back the push member when the installation of staples is carried out. In addition, the force exerted on the staples is not constant so that the staples are not stable, which can result in deviation, lifting and/or jamming of the staple.

The present invention is, therefore, arisen to obviate or at least mitigate the above-mentioned disadvantages.

SUMMARY OF THE INVENTION

The main object of the present invention is to provide a hammer tacker which can provide constant force for biasing at least one staple.

To achieve the above and other objects, the present invention provides a hammer tacker, including: a housing, including a grip portion and a body portion; a magazine, including a rail, at least partially received in the housing, being movable relative to the housing between a stapling position and a staple-installing position, including an outlet disposed at a front end of the body portion; a biasing mechanism, including a push member movably mounted to the rail and a constant force spring which is rollable, the constant force spring being positionally attached to the rail through a connection portion and located at a front end of the magazine, and the constant force spring being attached to an inner face of the push member, the push member being movable to be correspondingly above the connection portion and movable to be beyond the connection portion; a striking mechanism, mounted to the body portion and configured to strike at least one staple installed in the magazine.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
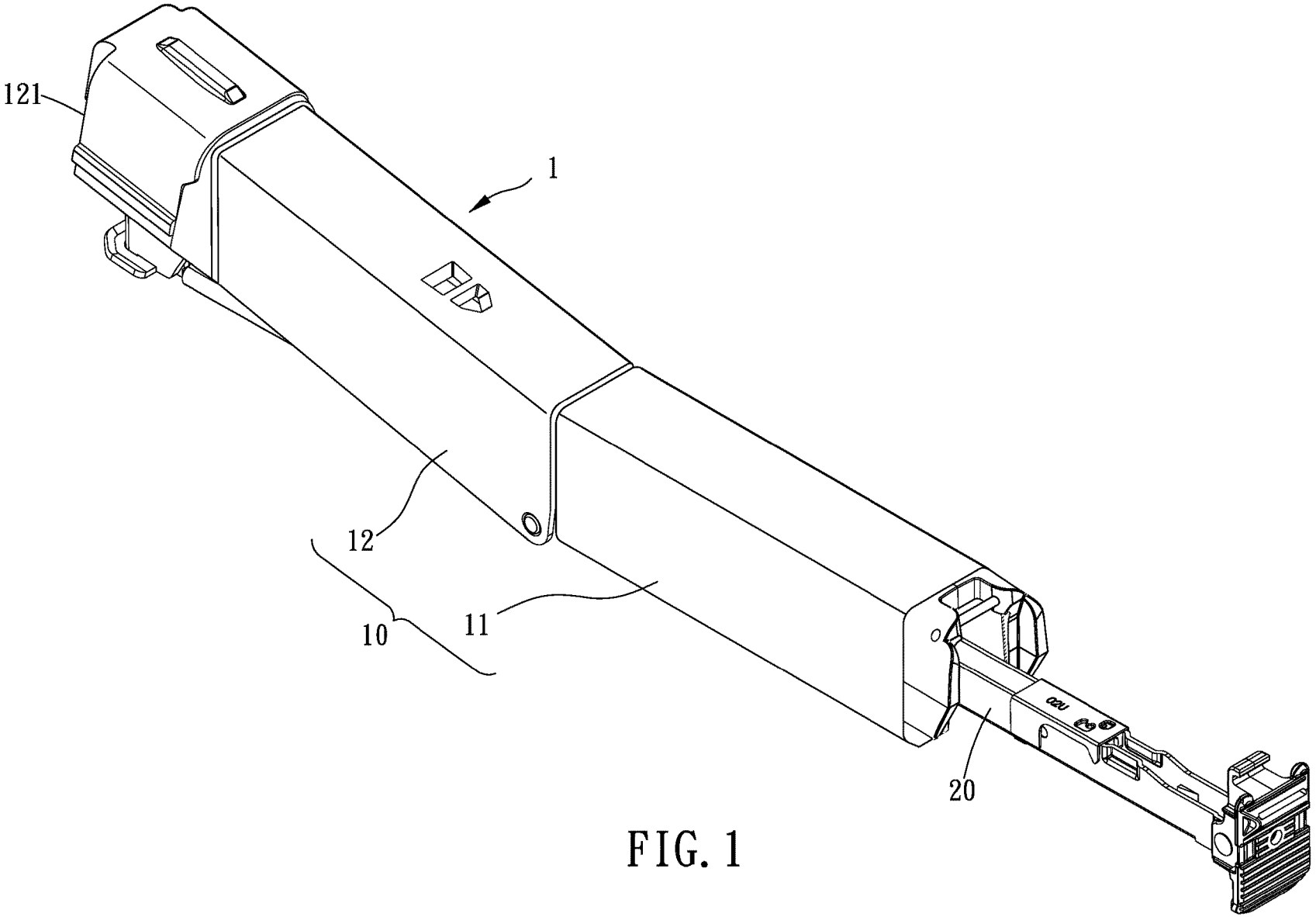
FIG. 1 is a stereogram of a preferable embodiment of the present invention.
Figure 2:
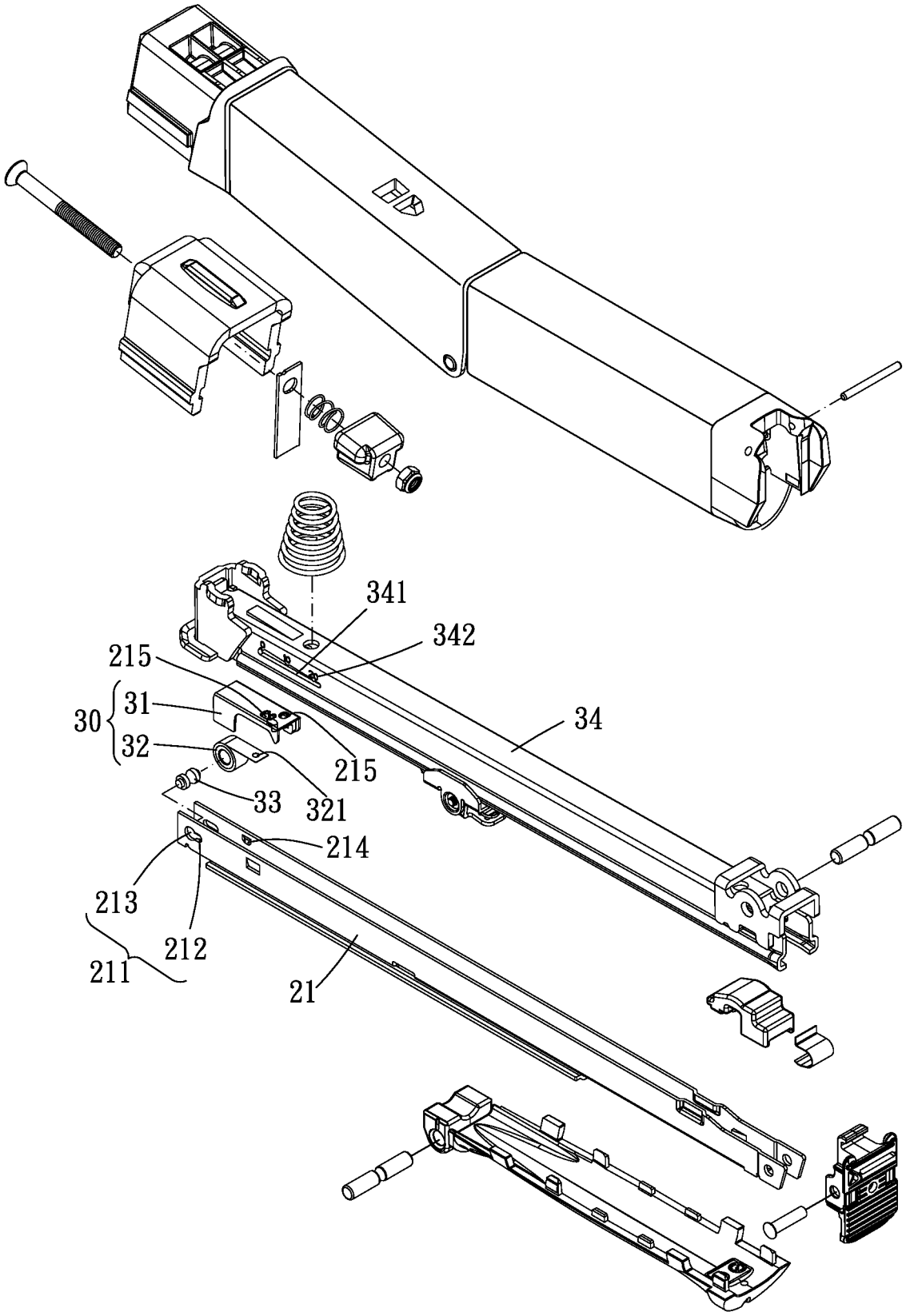
FIG. 2 is a breakdown drawing of a preferable embodiment of the present invention.
Figure 3:
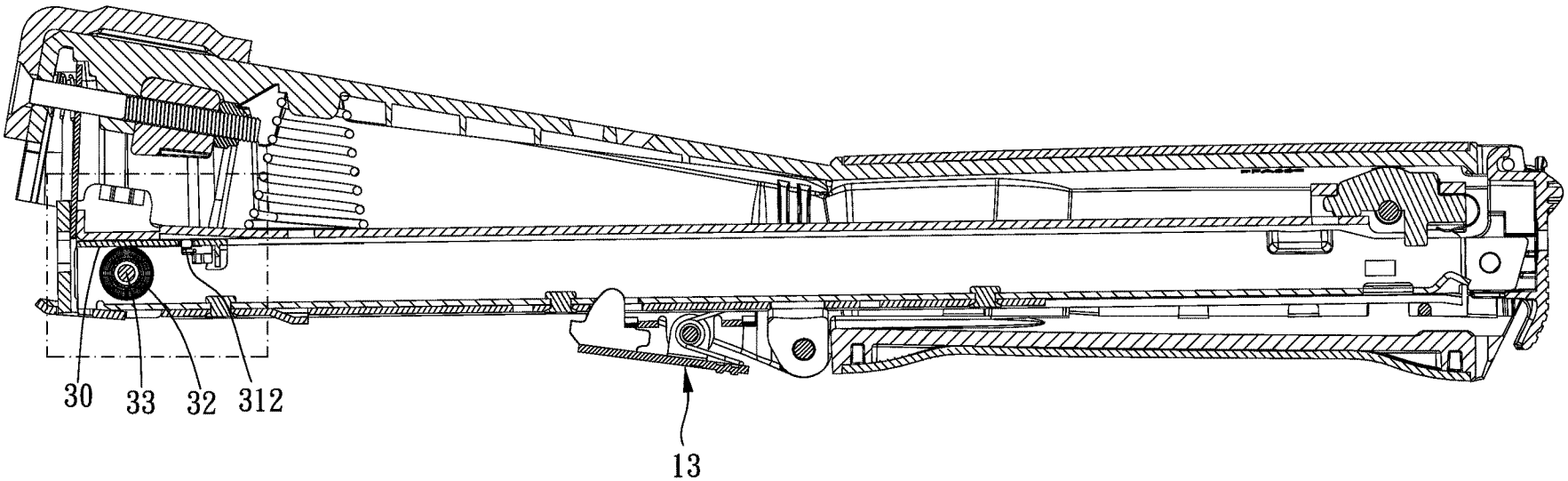
FIG. 3 is a longitudinal cross-sectional view of a preferable embodiment of the present invention.
Figure 4:
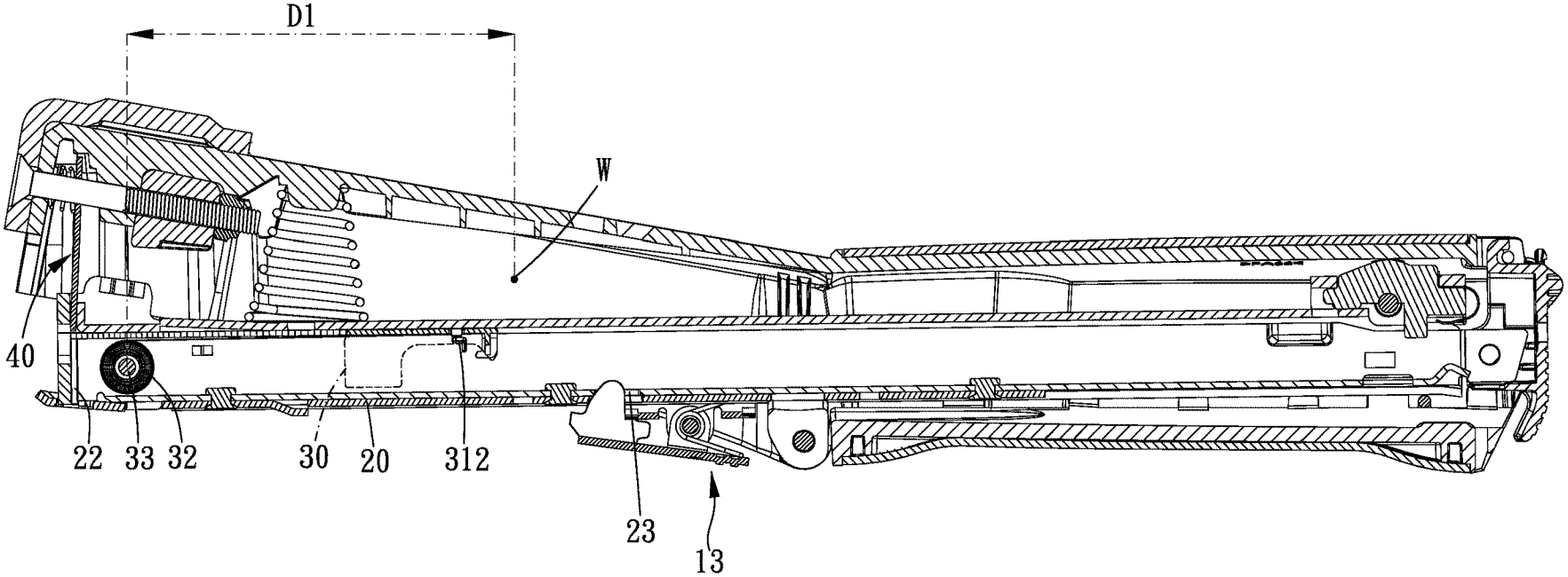
FIG. 4 is another longitudinal cross-sectional view of a preferable embodiment of the present invention.
Figure 5:
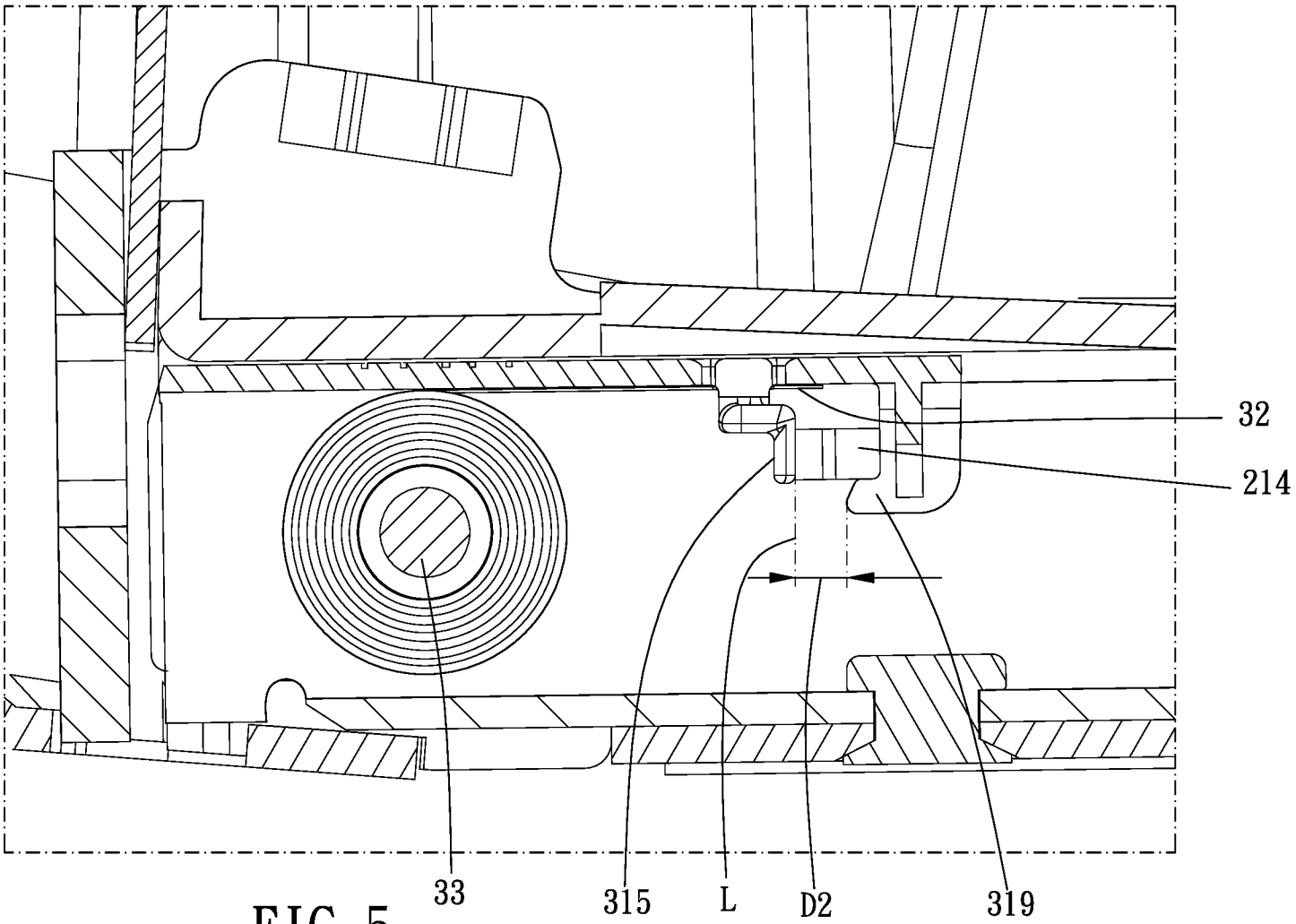
FIG. 5 is an enlargement of FIG. 3.
Figure 7:
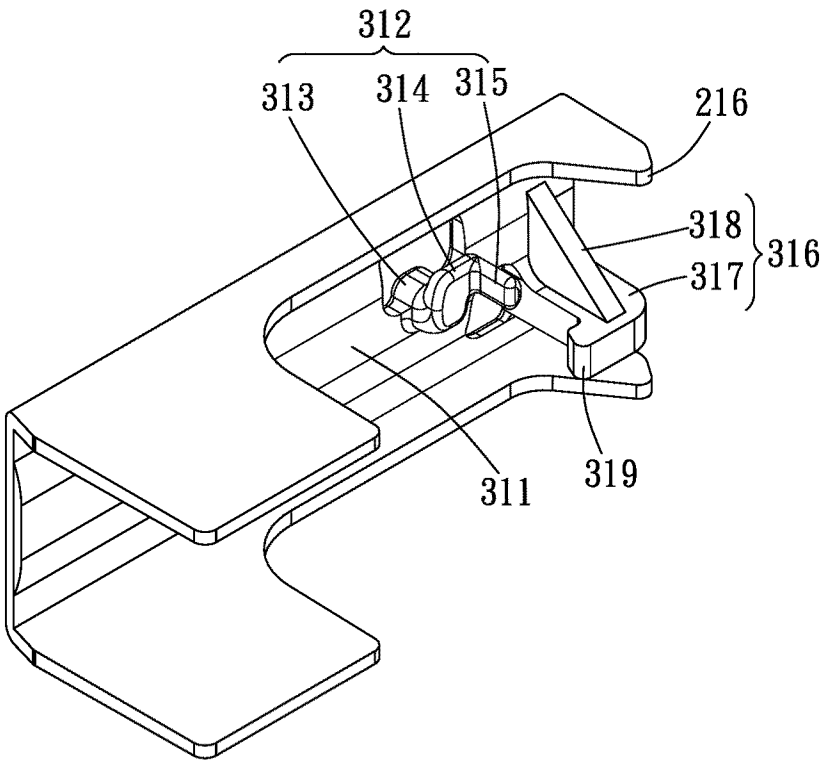
FIG. 7 is a stereogram showing a push member of a preferable embodiment of the present invention.
Figure 6:
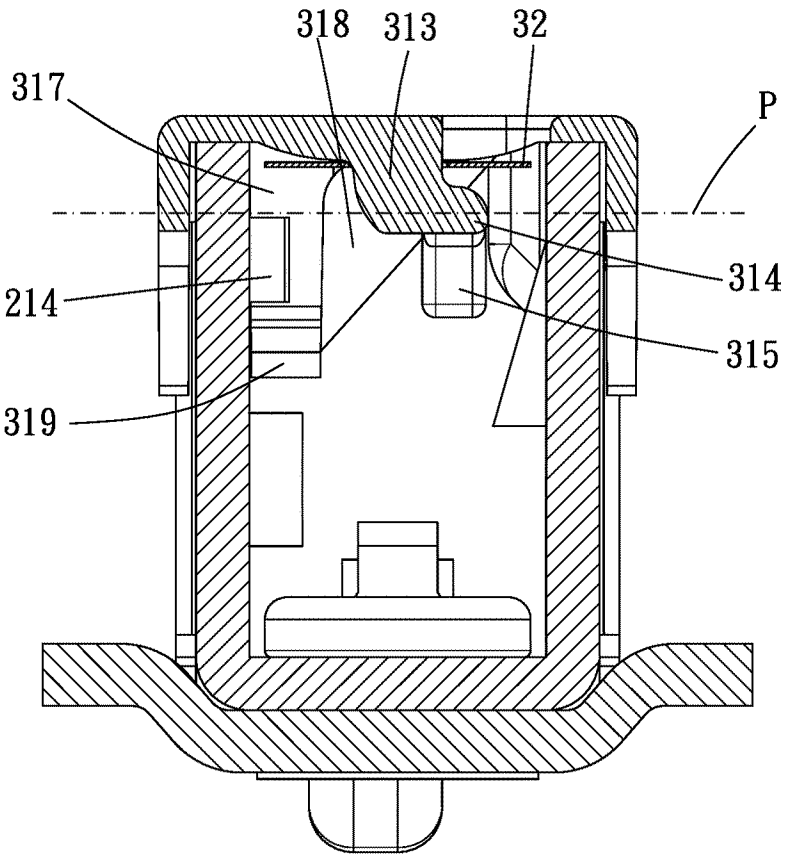
FIG. 6 is a widthwise cross-sectional view of a preferable embodiment of the present invention.

Please refer to FIGS. 1 to 7 for a preferable embodiment of the present invention. A hammer tacker 1 of the present invention includes a housing 10, a magazine 20, a biasing mechanism 30 and a striking mechanism 40.

The housing includes a grip portion 11 and a body portion 12; the magazine includes a rail 21 and at least partially received in the housing, the magazine is movable relative to the housing between a stapling position (FIGS. 3, 4) and a staple-installing position (FIG. 1), the magazine further includes an outlet 22 disposed at a front end 121 of the body portion; the biasing mechanism includes a push member 31 movably mounted to the rail and a constant force spring 32 which is rollable, the constant force spring is positionally attached to the rail through a connection portion 33 and located at a front end of the magazine, the constant force spring is attached to an inner face 311 of the push member, and the push member is movable to be correspondingly above the connection portion and movable to be beyond the connection portion; the striking mechanism is mounted to the body portion and configured to strike at least one staple installed in the magazine. Whereby, the constant force spring can provide constant force for biasing the at least one staple.

Preferably, the length from a transitional portion of the grip portion and the body portion to a distal end of the grip portion is greater than or equal to 120±2 mm; a ratio of a length of the grip portion to a length of the body portion is between 0.45 to 0.50, which give consideration to the center of gravity of the hammer tacker and easy gripping.

The rail includes at least one receiving hole 211, each of the at least one receiving hole includes a narrowed portion 212 and an enlarged portion 213 between the outlet and the narrowed portion, the connection portion is engaged within the narrowed portion of the at least one receiving hole, and the constant force spring is rollable around the connection portion. In this embodiment, each of opposing sides of the rail includes one said receiving hole, and the connection portion is a shaft disposed through the constant force spring, wherein the enlarged portion can facilitate mounting of the shaft, and the narrowed portion can facilitate stable attachment (such as slight tight fit) of the shaft. The constant force spring can also serve as a weight, which can providing good effects of hammering, light weight, shock absorption and noise reduction. A distance D1 from the connection portion to a center of gravity W of the hammer tacker is preferably greater than or equal to 95.00 mm and smaller than 125.00 mm.

The push member further includes a protruding member 312 protruding from the inner face, and the constant force spring is connected with the protruding member. The constant force spring may be connected with the protruding member through a pin, fastener or the like. The protruding member includes a neck portion 313 and a flange 314 extending laterally from the neck portion, the flange transitionally extends on a plane P parallel to the inner face, and the constant force spring includes a hooking hole 321 disposed around the neck portion. The flange can prevent detachment of the constant force spring from the neck portion. The protruding member further includes a leg portion 315 extending from the flange in a direction away from the inner face, and the leg portion is preferably sized radially smaller than the neck portion, thus facilitating mounting of the hooking hole to the protruding member. The leg portion, the flange and the neck portion transitionally extend in different directions (for example, in x, y and z directions), which can prevent detachment of the constant force spring from the protruding member.

The rail includes (preferably, is integrally formed with) a blocking protrusion 214, the push member further includes (preferably, is integrally formed with) a restriction member 316 facing the blocking protrusion and blockable by the blocking protrusion. The restriction member includes (preferably, is integrally formed with) a first wall 317 protruding from the inner face and a second wall 318 lateral to the first wall and connected between the inner face and the first wall, wherein the second wall is blockable by the blocking protrusion so as to block the push member, and the second wall can reinforce the structural strength of the restriction member. The flange transitionally extends toward the second wall (in a direction opposite a rolling direction of the constant force spring), thus effectively restrict the constant force spring. The first wall includes a hook portion 319 extending toward the front end of the magazine. Preferably, a part of the constant force spring extending from the hooking hole toward the restriction member is longer than or equal to a distance D2 from an extension line L of the leg portion to the hook portion, which can prevent detachment of the constant force spring from the leg portion, and the hook portion can hook the blocking protrusion so as to avoid lifting of the push member.

The inner face includes a plurality of through holes 215 via which the protruding member and the restriction member are visible, thus being capable of observing state of the constant force spring; the magazine further includes a cover 34 covering the rail and the push member for stably hold the push member, the cover includes at least one window portion 341 having at least one quantity mark 342, and the push member includes an index 216 visible from the at least one window portion and correspondable to the at least one quantity mark; the housing further includes a locking mechanism 13, the rail further includes a locking hole 23, the locking mechanism is releasably locked within the locking hole for locking the magazine in the stapling position, and when the locking mechanism is released from the locking hole, the magazine can be drawn to the staple-installing position for installation of the staples.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A hammer tacker, including:

a housing, including a grip portion and a body portion;

a magazine, including a rail, at least partially received in the housing, being movable relative to the housing between a stapling position and a staple-installing position, including an outlet disposed at a front end of the body portion;

a biasing mechanism, including a push member movably mounted to the rail and a constant force spring which is rollable, the constant force spring being positionally attached to the rail through a connection portion and located at a front end of the magazine, the constant force spring being attached to an inner face of the push member, and the push member being movable to be correspondingly above the connection portion and movable to be beyond the connection portion;

a striking mechanism, mounted to the body portion and configured to strike at least one staple installed in the magazine;

wherein the push member further includes a protruding member protruding from the inner face, and the constant force spring is connected with the protruding member wherein the protruding member includes a neck portion and a flange extending laterally from the neck portion, the flange transitionally extends on a plane parallel to the inner face, and the constant force spring includes a hooking hole disposed around the neck portion wherein the protruding member further includes a leg portion extending from the flange in a direction away from the inner face.

2. The hammer tacker of claim 1, wherein the rail includes a blocking protrusion, the push member includes a restriction member facing the blocking protrusion and blockable by the blocking protrusion, the restriction member includes a first wall protruding from the inner face and a second wall lateral to the first wall, the second wall is connected to the inner face and the first wall, and the flange transitionally extends toward the second wall.

3. The hammer tacker of claim 2, wherein the first wall includes a hook portion extending toward the front end of the magazine.

4. The hammer tacker of claim 3, wherein the rail is integrally formed with the blocking protrusion, the push member is integrally formed with the restriction member, the restriction member is integrally formed with the first and second walls, the leg portion is sized radially smaller than the neck portion; a part of the constant force spring extending from the hooking hole toward the restriction member is longer than or equal to a distance from an extension line of the leg portion to the hook portion; the inner face includes a plurality of through holes via which the protruding member and the restriction member are visible; the magazine further includes a cover covering the rail and the push member, the cover includes at least one window portion having at least one quantity mark, the push member includes an index visible from the at least one window portion and correspondable to the at least one quantity mark; the housing further includes a locking mechanism, the rail further includes a locking hole, the locking mechanism is releasably locked within the locking hole; a ratio of a length of the grip portion to a length of the body portion is between 0.45 to 0.50.

5. The hammer tacker of claim 1, wherein a distance from the connection portion to a center of gravity of the hammer tacker is greater than or equal to 95.00 mm and smaller than 125.00 mm.

6. A hammer tacker, including:

a housing, including a grip portion and a body portion;

a magazine, including a rail, at least partially received in the housing, being movable relative to the housing between a stapling position and a staple-installing position, including an outlet disposed at a front end of the body portion;

a biasing mechanism, including a push member movably mounted to the rail and a constant force spring which is rollable, the constant force spring being positionally attached to the rail through a connection portion and located at a front end of the magazine, the constant force spring being attached to an inner face of the push member, and the push member being movable to be correspondingly above the connection portion and movable to be beyond the connection portion;

a striking mechanism, mounted to the body portion and configured to strike at least one staple installed in the magazine;

wherein the rail includes at least one receiving hole, each of the at least one receiving hole includes a narrowed portion and an enlarged portion between the outlet and the narrowed portion, the connection portion is engaged within the narrowed portion of the at least one receiving hole, and the constant force spring is rollable around the connection portion.

* * * * *